US010448468B2

(12) United States Patent
Li

(10) Patent No.: US 10,448,468 B2
(45) **Date of Patent: *Oct. 15, 2019**

(54) LED BACKLIGHT DRIVING CIRCUIT AND LIQUID CRYSTAL DISPLAY

(71) Applicant: Shenzhen China Star Optoelectronics Technology Co., Ltd., Shenzhen, Guangdong (CN)

(72) Inventor: Wendong Li, Guangdong (CN)

(73) Assignee: Shenzhen China Star Optoelectronics Technology Co., Ltd., Shenzhen, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/258,795

(22) Filed: Jan. 28, 2019

(65) Prior Publication Data

US 2019/0159304 A1 May 23, 2019

Related U.S. Application Data

(63) Continuation of application No. 15/535,440, filed on Jun. 13, 2017, now Pat. No. 10,397,994.

(51) Int. Cl.
*H05B 33/08* (2006.01)
*G09G 3/34* (2006.01)

(52) U.S. Cl.
CPC ..... *H05B 33/083* (2013.01); *G09G 3/3406* (2013.01); *H05B 33/0806* (2013.01);
(Continued)

(58) Field of Classification Search
CPC ..... H05B 33/0815; H05B 33/0827; H05B 33/083; H05B 33/0806; H05B 33/0809; H05B 33/0842
See application file for complete search history.

(56) References Cited

U.S. PATENT DOCUMENTS 7,919,936 B2 * 4/2011 Liu ..... H05B 33/0827 315/185 R
8,232,743 B2 7/2012 Chen
(Continued)

FOREIGN PATENT DOCUMENTS

CN 102195470 A 9/2011
CN 102625518 A 8/2012
(Continued)

OTHER PUBLICATIONS

CN 2017100045082—1st Office Action.
PCTCN2017071261PCT_International Search Report.

*Primary Examiner* — Tung X Le
*Assistant Examiner* — Borna Alaeddini
(74) *Attorney, Agent, or Firm* — Andrew C. Cheng

(57) ABSTRACT

An LED backlight driving circuit includes a first and a second LED strings; a first and a second capacitors; a boosted circuit having an input connected to a power source and an output connected to the first and second capacitors and the first and second LED strings; an LED controller electrically connected to the boosted circuit so as to control, in a first period of an operation cycle, the boosted circuit to supply power to the first branch and to charge the first capacitor and also to supply power to the second branch and to charge the second capacitor; and in a second period, LED controllers controls the boosted circuit to cut off the first and second branches to make the first and second capacitors discharge to the first and second branches, respectively. Also provided is a liquid crystal display that includes the LED backlight driving circuit.

16 Claims, 5 Drawing Sheets

(52) U.S. Cl.
CPC ..... *H05B 33/0809* (2013.01); *H05B 33/0842* (2013.01); *G09G 2330/00* (2013.01)

(56) References Cited

U.S. PATENT DOCUMENTS

| | | | | |
|---|---|---|---|---|
| 2011/0234122 | A1* | 9/2011 | Yu | G09G 3/3406 315/297 |
| 2013/0093355 | A1 | 4/2013 | Han | |
| 2016/0033716 | A1* | 2/2016 | Gotou | G02B 6/0021 348/790 |
| 2016/0323946 | A1 | 11/2016 | Lee | |
| 2017/0374713 | A1* | 12/2017 | Liu | G05F 1/40 |

FOREIGN PATENT DOCUMENTS

| | | | |
|---|---|---|---|
| CN | 102682698 | A | 9/2012 |
| CN | 102740535 | A | 10/2012 |
| CN | 204423880 | U | 6/2015 |
| CN | 205491350 | U | 8/2016 |
| CN | 106131996 | A | 11/2016 |
| CN | 106205505 | A | 12/2016 |

* cited by examiner

LED BACKLIGHT DRIVING CIRCUIT AND LIQUID CRYSTAL DISPLAY

CROSS REFERENCE TO RELATED APPLICATIONS

This is a continuation application of co-pending U.S. patent application Ser. No. 15/535,440, filed on Jun. 13, 2017, which is a national stage of PCT Application No. PCT/CN2017/071261, filed on Jan. 16, 2018, claiming foreign priority of Chinese Patent Application No. 201710004508.2, entitled "LED Backlight Driving Circuit and Liquid Crystal Display" filed on Jan. 4, 2017, the disclosure of which is incorporated herein by reference in its entirety.

FIELD OF THE INVENTION

This invention relates to the technical field of liquid crystal displays, and more particularly to a light-emitting diode (LED) backlight and a liquid crystal display driving circuit.

FIELD OF THE INVENTION

With advances in display technology, liquid crystal display backlight technology has been further developed. Cold cathode fluorescent lamp (CCFL) is applied for conventional liquid crystal display backlight. However, due to CCFL backlight has disadvantages such as poor color reproduction, low luminous efficiency, high discharge voltage, poor discharge characteristics at low temperature, and long heating time to achieve stable gray scale, the backlight technology using LED (Light Emitting Diode) backlight has been developed.

FIG. 1 shows a current LED backlight driving circuit for a liquid crystal display. As shown in FIG. 1, the LED backlight driving circuit includes a boosted circuit, a LED controller, capacitors C1' and an LED string. The boosted circuit includes an inductor L', a diode D1', a first transistor Q1' and a first resistor R1', wherein one end of the inductor L' receives input power of the voltage direct voltage Vin, the other end of the inductor L' is electrically connected to the anode of the diode D1' and connected to the drain of the first transistor Q1', the gate (control terminal) of the first transistor Q1' is driven by the first control signal supplied by the LED controller, the source of the first transistor Q1' is connected to ground through the first resistor R1'; the cathode of the diode D1' is electrically connected to the positive end of the LED string, the cathode of the diode D1' is also electrically connected to ground through the capacitor C1'. The negative end of the LED string is also connected to the second transistor Q2', wherein the drain of the second transistor Q2' is connected to the negative end of the LED string, the source of the second transistor Q2' is electrically connected to ground through the second resistor R2', the gate of the second transistor Q2' is driven by the second control signal supplied by LED controller, by changing the duty cycle of the second control signal, the operating current of the LED string can be increased or decreased to control the brightness of the LED string.

During the process of using the LED backlight driving circuit, the inventors of this invention have found that, with the panel becomes larger and the demands of outdoor display or commercial display, the number of LED lights needed becomes more and more; for example, the number of the LED string contains more than 16 or more, each LED light is connected in series, resulting in that the output voltage Vout of the inductor L1 needs to be increased in order to drive the LED string after boosting the voltage, for example, it requires more than 90V, 100V or more, due to the fact that the conversion efficiency of the boosted circuit is inversely proportional to voltage, that is, the higher the voltage rises, the lower the conversion efficiency, this results in reduction of the conversion efficiency of the boosted circuit and waste of energy.

SUMMARY OF THE INVENTION

Technical problems in the embodiments of this invention to be solved is to provide an LED backlight driving circuit and a liquid crystal display. It can be used to save energy.

To solve the above problems, a first aspect of this invention provides a LED backlight driving circuit including:

a first LED string, located on a first branch, including at least two LED lights;

a second LED string, and in the second branch path different from the first branch, which includes at least two LED lights;

a first capacitor, electrically connected with the first LED string;

a second capacitor, electrically connected to the second LED string;

a boosted circuit, an input terminal of which is electrically connected to the power source for power access and an output terminal of which is electrically connected to the first capacitor, the second capacitor, the first LED string, and the second LED string, respectively;

an LED controller, electrically connected to the boosted circuit, in the first period the LED controller is used for controlling the boosted circuit to supply power to the first branch and to charge the first capacitor and for controlling the boosted circuit to supply power to the second branch and to charge the second capacitor; in the second period the LED controller is used for controlling the boosted circuit to cut off the first branch so that the first capacitor charges to the first branch, and the LED controller is used for controlling the boosted circuit to cut off the second branch so that the second capacitor charges to the second branch circuit.

In one embodiment of the first aspect of this invention, the boosted circuit includes: an inductor, having an input terminal for electrically connecting the power source; a first diode, having an anode electrically connected to the output terminal of the inductor and a cathode electrically connected to the positive terminal of the first LED string and one end of the first capacitor, the other end of the first capacitor is electrically grounded; a second diode, having an anode electrically connected to the output terminal of the inductor and a cathode electrically connected to the positive terminal of the second LED string and one end of the second capacitor, the other end of the second capacitor is electrically grounded; a third diode, having an anode electrically connected to the negative terminal of the second LED string and a cathode electrically connected to the anode of the first diode; a first transistor, having a drain electrically connected to the output terminal of the inductor and a source electrically grounded and a control terminal electrically connected to the LED controller.

In one embodiment of the first aspect of this invention, the boosted circuit further includes a third capacitor, an output of the inductor is connected to the anode of the first diode anode through the third capacitor.

In one embodiment of the first aspect of this invention, the backlight LED driving circuit further includes a fourth capacitor having one end electrically connected to the negative terminal of the second LED string and the other end electrically grounded.

In one embodiment of the first aspect of this invention, the voltage of second capacitor in the second period is larger than the one of the fourth capacitor.

In one embodiment of the first aspect of this invention, in the first period when the first transistor is turned off, the first diode and the second diode is turned on, and the third diode is turned off; in the second period when the first transistor is turned on, the first diode and the second diode is turned off, and the third diode is turned on.

In one embodiment of the first aspect of this invention, the first transistor is an NMOS transistor.

In one embodiment of the first aspect of this invention, the first period and the second period are contained within a cycle.

In one embodiment of the first aspect of this invention, the first LED string has at least two LED lights connecting in series, the second LED string has at least two LED lights connecting in series, the number of LED string lights of the first LED string and the second LED string are equal.

In one embodiment of this invention in the second aspect provides a liquid crystal display, including a liquid crystal panel and a backlight module oppositely disposed, the backlight module provides a light source to the liquid crystal display panel, so that the liquid crystal panel displays can show images; the backlight module uses an LED backlight, the LED backlight is driven by using the LED backlight driving circuit.

Implementing the embodiments of this invention has the beneficial effects as follows:

due to the way from separating one circuit of the existing LED string into two circuits of the first and the second LED string, so that voltages of the first and second LED string outputted via the boosted circuit can be reduced relative to the prior art, thereby conversion efficiency of the boosted circuit can be improved to save energy; and driving a large number of LED lights can be achieved.

BRIEF DESCRIPTION OF THE DRAWINGS

In order to illustrate technical schemes of the present invention or the prior art more clearly, the following section briefly introduces drawings used to describe the embodiments and prior art. Obviously, the drawing in the following descriptions is just some embodiments of the present invention. The ordinary person in the related art can acquire the other drawings according to these drawings without offering creative effort.

LIST OF REFERENCE NUMERALS

110: first LED string; 120: second LED string; C1: first capacitor; C2: second capacitor; 140, 240: boosted circuit; L: inductor; D1: first diode; D2: second diode; D3: third diode; Q1: first transistor; C3: third capacitor; 150: LED controller; C4: fourth capacitor; Q2: second transistor; C5: fifth capacitor; C6: sixth capacitor.

DETAILED DESCRIPTION OF EMBODIMENTS

The following sections offer a clear, complete description of the present invention in combination with the embodiments and accompanying drawings. Obviously, the embodiments described herein are only a part of, but not all of the embodiments of the present invention. In view of the embodiments described herein, any other embodiment obtained by those of ordinary skill in the art skilled in this art without offering creative effort is included in a scope claimed by the present invention.

In this specification, claims, and drawings, the terms "comprises," "comprising," "includes," "including," "has," "having" or any other variation thereof are intended to cover a non-exclusive inclusion. For example, a process, method, system, product or apparatus that comprises a list of steps or elements is not necessarily limited to only those elements but may optionally include other steps or elements not listed or inherent to such process, method, product, or apparatus. In addition, the terms "first", "second" and "third" are used to distinguish between different objects, rather than to describe a specific order.

First Embodiment

Figure 1:
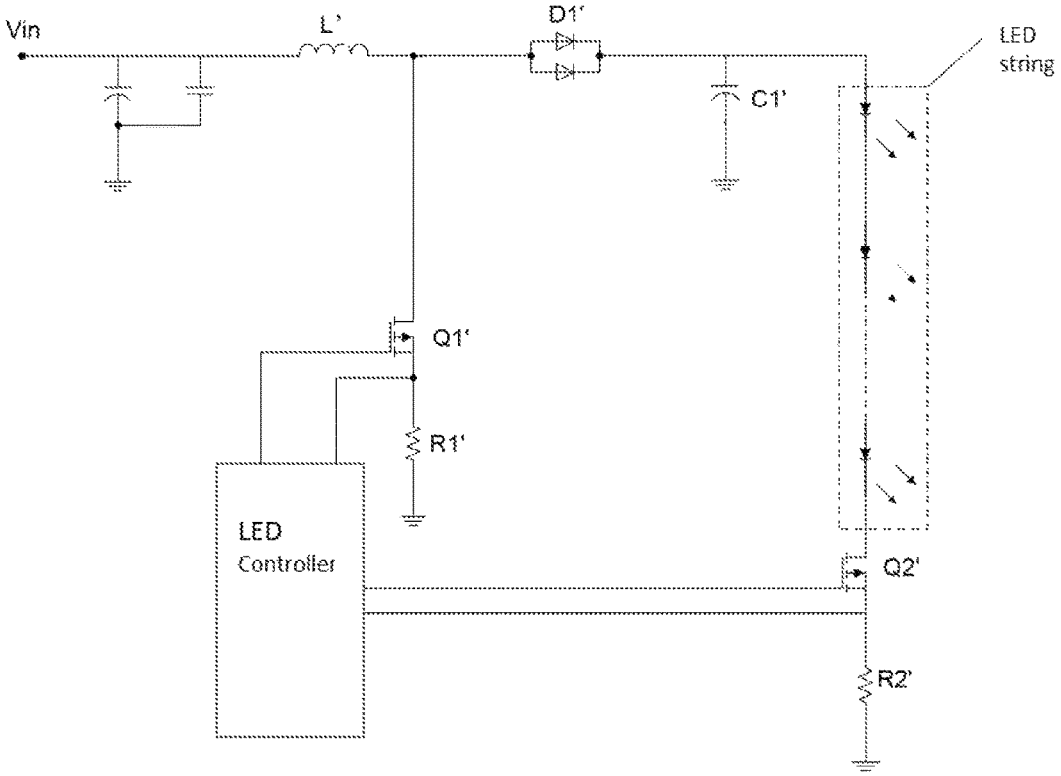
FIG. 1 is a circuit diagram of the LED backlight driving circuit according to the prior art.
Figure 2:
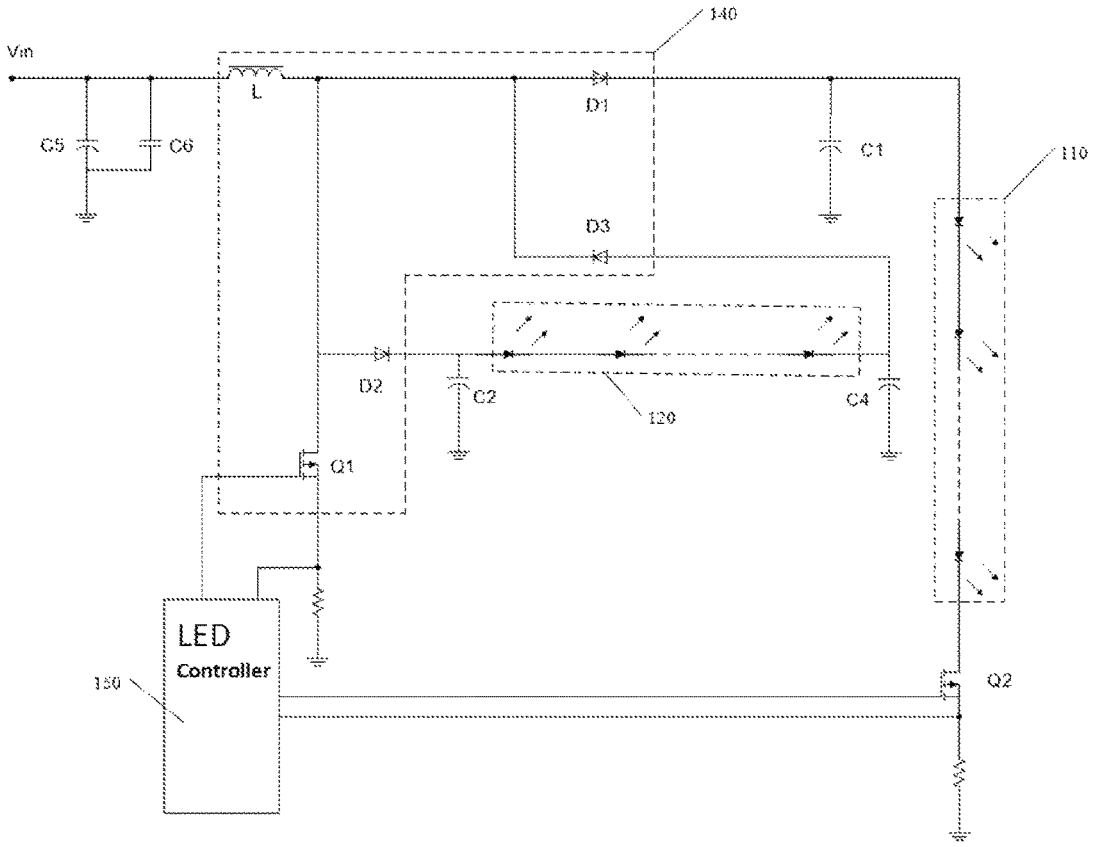
FIG. 2 is a circuit diagram of the LED backlight driving circuit according to the first embodiment of this invention.

Referring to FIG. 2, the first embodiment of this invention provides an LED backlight driving circuit, the LED backlight driving circuit includes the first LED string 110, the second LED string 120, the first capacitor C1, the second capacitor C2, the boosted circuit 140 and the LED controller 150.

Specifically, the first LED string 110 is on the first branch, the first LED string 110 includes at least two LED lights, for example, the number of two LED lights, 4 LED lights, 6 LED lights, 8 LED lights, 9 LED lights, 10 LED lights, in this embodiment, the at least two LED lights are connected in series, however, in other embodiments of this invention, the at least two LED lights can also be connected in parallel.

The second LED string 120 is located on the second branch different from the first branch, the first and the second branches are connected in parallel, the second LED string 120 includes at least two LED lights, for example, the number of two LED lights, 4 LED lights, 6 LED lights, 8 LED lights, 9 LED lights, 10 LED lights, in this embodiment, the at least two LED lights are connected in series, however, in other embodiments of this invention, the at least two LED lights can also be connected in parallel. In this embodiment, the number of LED lights included by the first LED string 110 is equal to the one included by the second LED string 120, of course, in other embodiments of this invention, the number of LED lights included by the first LED string can also be unequal to the one included by the second LED string.

One end of the first capacitor C1 is electrically connected to the first LED string 110, the other end of the first capacitor C1 is electrically grounded, after the first capacitor C1 has been charged, the first capacitor C1 can supply power to the first branch, for example, the first capacitor C1 supplies power to the first branch in 25 microseconds (μs), so that the first LED string 110 on the first branch can be lighted.

One end of the second capacitor C2 is electrically connected to the second LED string 120, the other end of the second capacitor C2 is electrically grounded, after the second capacitor C2 has been charged, the second capacitor C2 can supply power to the second branch, for example, the second capacitor C2 supplies power to the second branch in 25 microseconds (μs), so that the second LED string 120 on the second branch can be lighted.

The input terminal of the boosted circuit 140 is electrically connected to the power source, i.e. the output voltage Vin of the power source supplies to the input terminal of the boosted circuit 140, the power source can be, for example, a direct current (DC) power source supplied by another power source circuit, or a DC power source supplied by a power supply manager, the output voltage of the power source can be, for example, 12V (volts), 24V, the boosted voltage circuit 140 is used to increase the output voltage of the power source, for example, increased by a 24V to 36V, 48V, 60V, 72V; the output terminal of the boosted circuit 140 is electrically connected to the first capacitor C1, the second capacitor C2, the first LED string 110, and the second LED string 120, respectively. Specifically, the boosted circuit 140, for example, has two output terminals, the first output terminal of the boosted circuit 140 is electrically connected to the first LED string 110 and the first capacitor C1 respectively, thereby the electric power inputted by the power source can respectively supply to the first LED string 110 and the first capacitor C1 from its first output terminal after the boosted circuit 140 has been boosted, so that the LED light on the first LED string 110 can be lighted and the first capacitor C1 can be charged, the second output terminal of the boosted circuit 140 is electrically connected to the second LED string 120 and the second capacitor C2 respectively, thereby the electric power inputted by the power source can respectively supply to the second LED string 120 and the second capacitor C2 from its second output terminal after the boosted circuit 140 has been boosted, so that the LED light on the second LED string 120 can be lighted and the second capacitor C2 can be charged.

The LED controller 150 is electrically connected to the boosted circuit 140, in the first period the LED controller 150 is used for controlling the boosted circuit 140 to supply power to the first branch to charge the first capacitor C1 and to control the boosted circuit 140 to supply power to the second branch to charge the second capacitor C2; in the second period LED controller 150 is also used for controlling the boosted circuit 140 so that the first capacitor C1 supplies power to the first branch and the second capacitor C2 supplies power to the second branch, in specific during the second period the LED controller is used for controlling the boosted circuit 140 to cut off the first branch so that the first capacitor C1 supplies power to the first branch while the power source is not supplying power to the first branch, in the second period the LED controller is used for controlling the boosted circuit 140 to cut off the second branch so that the second capacitor C2 supplies power to the second branch while the power source is not supplying power to the second branch. Thereby lighting LED lights on the first LED string 110 and the second LED light string 120 in the first period and the second period can be achieved, the first period and the second period are different, the first period and the second period are processing alternately, for example, use time as x-axis, at the first is the first period, followed by the second period, followed by the first period, followed by the second period, and continuously like this.

Thus, in this embodiment, due to the way from separating one circuit of the existing LED string into two circuits of the first LED string 110 and a second LED string 120, so that voltages of the first LED string 110 and second LED string 120 outputted via the boosted circuit 140 can be reduced relative to the prior art, thereby conversion efficiency of the boosted circuit 140 can be improved to save energy; and driving a large number of LED lights can be achieved.

In this embodiment, the boosted circuit 140 includes the inductor L, the first diode D1, the first transistor Q1, the second diode D2 and the third diode D3. Specifically, the input terminal of the inductor L is used for electrically connecting the power source, i.e. the output voltage Vin of the power source supplies power to the input terminal of the inductor L, the anode of the first diode D1 is directly electrically connected to the output terminals of the inductor L, the cathode of the first diode D1 is electrically connected to the positive terminal of the first LED string 110 and one end of the first capacitor C1 respectively, the other end of the first capacitor C1 is electrically grounded. The anode of the second diode D2 is electrically connected to the output terminal of the inductor L, the cathode of the second diode D2 is electrically connected to the positive terminal of the second LED string 120 and one end of the second capacitor C2, the other end of the second capacitor C2 is electrically grounded; the anode of the third diode D3 is electrically connected to the negative terminal of the second LED string 120, the cathode of the third diode D3 is electrically connected to the first diode D1, i.e. in this embodiment, the cathode of the third diode D3 is also electrically connected to the output terminal of the inductor L; the drain of the first transistor Q1 is electrically connected to the output terminal of the inductor L, the source of the first transistor Q1 is electrically grounded and is electrically grounded indirectly in this embodiment, the source of the first transistor Q1 is electrically grounded through a resistor, the control terminal (gate) of the first transistor Q1 is electrically connected to the LED controller 150. In other embodiments of this invention, the source of the first transistor can also be directly electrically grounded.

Figure 3:
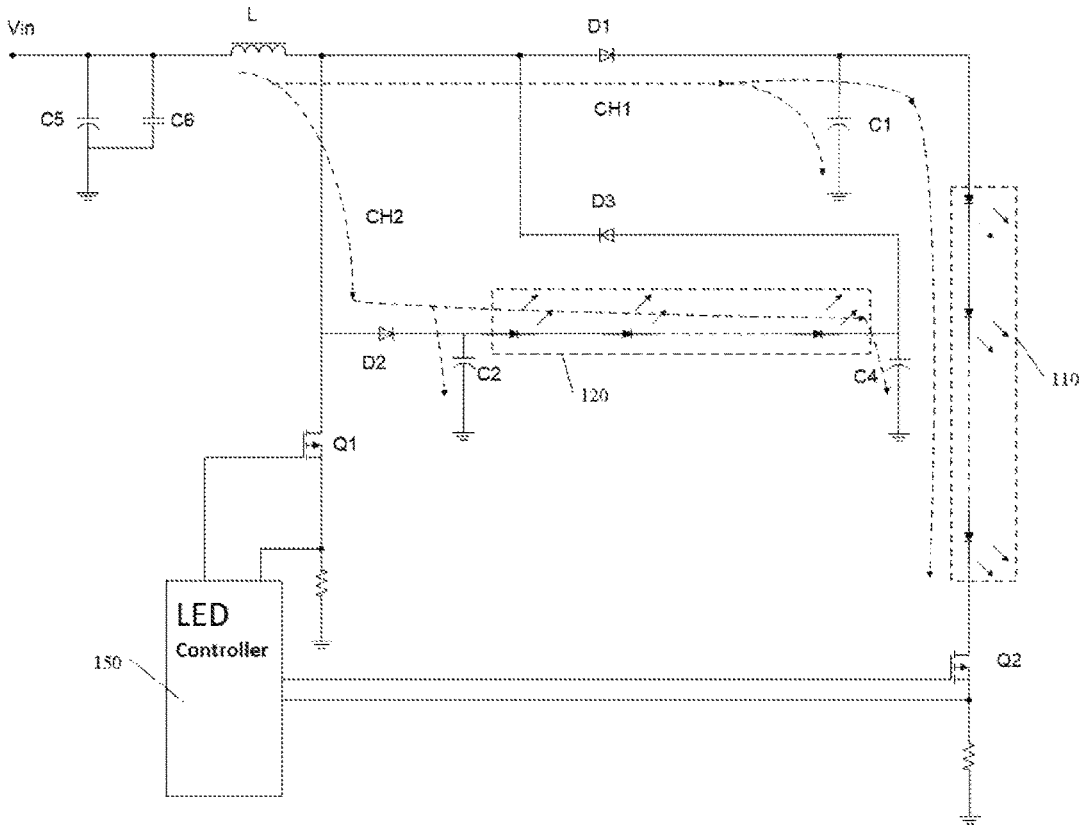
FIG. 3 is a current flow diagram of the LED backlight driving circuit in the first period according to the first embodiment of this invention.
Figure 4:
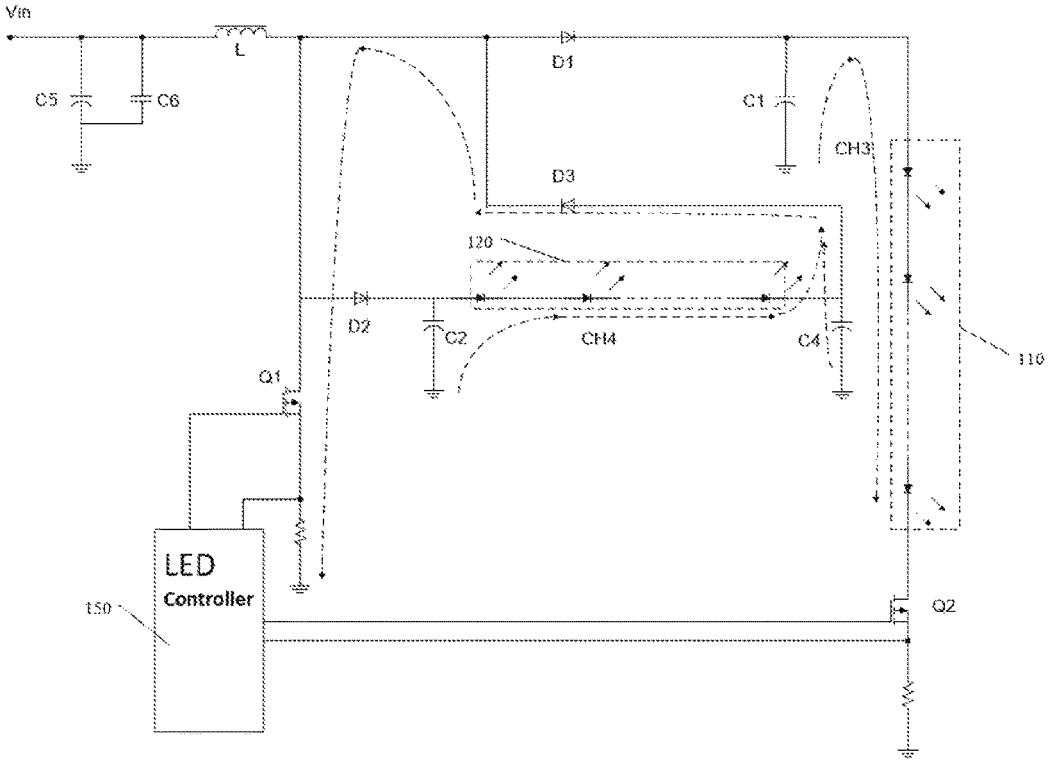
FIG. 4 is a current flow diagram of the LED backlight driving circuit in the second period according to the first embodiment of this invention.

Thus, the LED controller 150 controls the boosted circuit 140 by controlling the first transistor Q1 to be turned on and off, specifically, in the first period the LED controller 150 controls the first transistor Q1 to be turned off, at this time the first diode is turned on, after being boosted by the boosted circuit 140, the electrical power inputted by the power source supplies power to the first branch through the first output terminal and charges the first capacitor C1 at the same time, see the current flow path CH1 of FIG. 3, i.e. a current flowing route is: Vin→the inductor L→the first diode D1→the first LED string 110→the second transistor Q2 (to be described later)→resistor (to be described later) →ground (to be described later) and Vin→the inductor L→the first diode D1→the first capacitor C1→ground; meanwhile, when the second diode D2 is turned on and the third diode D3 is turned off, after being boosted by the boosted circuit 140, the electrical power inputted by the power source supplies power to the second branch through the second output terminal and charges the capacitor C2 at the same time, see the current flow path CH2 of FIG. 3, i.e. a current flowing route is: Vin→the inductor L→the second diode D2→the second LED string 120→the fourth capacitor C4 (to be described later)→ground, and Vin→the inductor L→the second diode D2→the second capacitor C2→ground; in the second period the LED controller 150 controls the first transistor Q1 to be turned on, then the power source outputs the electrical power to the inductor L to store energy, when the first diode D1 is turned off, the first capacitor C1 releases electrical energy to supply power to the first LED string 110, see the current flow path CH3 of FIG. 4, i.e. a current flowing route is: the first capacitor C1→the first LED string 110→the second transistor Q2 (to be described later)→resistor (to be described later)→ground (to be described later); meanwhile, when the second diode D2 is turned off and the third diode D3 is turned on, the second capacitor C2 releases electrical energy to supply power to the second LED string 120, see the current flow path CH4 of FIG. 4, i.e. a current flowing route is: the second capacitor C2→the second LED string 120→the third diode D3→the first transistor Q1→resistor (to be described later)→ground (and there is still another route: the fourth capacitor C4→the third diode D3→the first transistor Q1→resistor (to be described later)→ground). Thus, since the output voltage of the power source through the boosted circuit 140 can be reduced, namely the output voltage of the output terminal of the inductor L can be reduced, so that the stress endured by the first transistor Q1 and the first diode D1 can be reduced, so as not to affect the lifetimes of the first transistor Q1 and the first diode D1, and will not cause the damages of the first transistor Q1 and the first diode D1.

In this embodiment, the first transistor Q1 is an NMOS transistor, and of course, in other embodiments of this invention, the first transistor can also be a switch equivalent to an NMOS transistor.

In this embodiment, the first and second periods form a cycle, namely the sum of the first and second periods is equal to a cycle time, specifically, the first and the second periods form the cycle of the first transistor Q1, for example, the time during the transistor Q1 is turned on once and is turned off once is a cycle, the sum of the first and second periods is equal to a cycle time of the first transistor Q1, the cycle time is for example, 50 μs, the first transistor Q1 acts periodically. However, in other embodiments of this invention, the first and the second periods may be less than a cycle, that is to say, a cycle may also include a third period, that is, in this invention, the first and the second periods can be included within a cycle.

In this embodiment, the LED backlight driving circuit further includes the fourth capacitor C4, one end of the fourth capacitor C4 is electrically connected to the negative terminal of the second LED string 120, namely it is electrically connected to the anode of the third diode D3, the other end of the fourth capacitor C4 is electrically grounded. Thus, in the first period, after being boosted by the boosted circuit 140, the electrical power inputted by the power source supplies power to the second LED string through the second output terminal and charges the fourth capacitor C4; in the second period, the fourth capacitor C4 releases electrical energy and outputs via the third diode D3, namely the current route is the fourth capacitor C4→the third diode D3→the first transistor Q1→resistor (to be described later)→ground. In this embodiment, the voltage on the second capacitor in the second period is larger than the one on the fourth capacitor C4, so that the capacitor C2 releases the electrical energy to drive the LED lights of the second LED string 120 to be lighted, and the second capacitor C2 can be charged rapidly.

In this embodiment, in order to better control the brightness of the first LED string, the LED backlight driving circuit further includes the second transistor Q2, the second transistor Q2 is also an NMOS transistor or the like, the drain of the second transistor Q2 is electrically connected to the negative terminal of the first LED string 110, the source of the second transistor Q2 is electrically grounded, in this embodiment, it is an indirect electrically grounded, the source of the second transistor Q2 is electrically grounded via a resistor. In other embodiments of this invention, the source of the second transistor may be directly electrically grounded. The control terminal (gate) of the second transistor Q2 is electrically connected to the LED controller 150, the LED controller 150 controls the second transistor Q2 to be turned on or off, thereby increasing or decreasing the operating current of the first LED string 110, so that the overall brightness of the first LED string 110 can be controlled.

Further, in this embodiment, the LED backlight driving circuit further includes the fifth capacitor C5 and the sixth capacitor C6, one ends of the fifth capacitor C5 and one end of the sixth capacitor C6 are electrically connected to the power source, the other ends of the fifth capacitor C5 and the sixth capacitor C6 are electrically connected to grounded, the fifth capacitor C5 and the sixth capacitor C6 is used for filtering.

This embodiment also provides a liquid crystal display, including a liquid crystal panel and a backlight module oppositely disposed, the backlight module provides the light source to the liquid crystal display panel, so that the liquid crystal panel display can show images; the backlight module uses an LED backlight, the LED backlight is driven by using the above-mentioned LED backlight driving circuit.

In this embodiment, since the first LED string 110 and the second LED string 120 is driven separately, whereby the average brightness of the two may be different, for example, the average brightness of the first LED string 110 is brighter, and the average brightness of the second LED string 120 is darker, or vice versa, resulting in a lower grade of a liquid crystal display, the second embodiment is described as follows.

Second Embodiment

Figure 5:
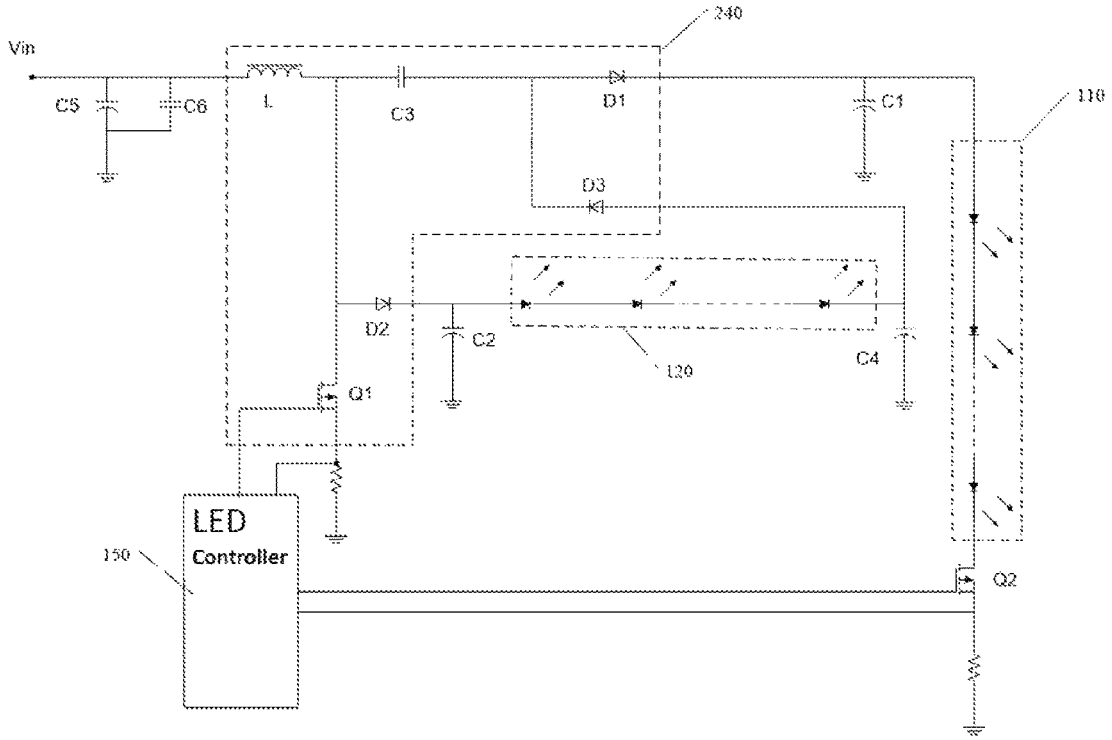
FIG. 5 is a circuit diagram of the LED backlight driving circuit according to the second embodiment of this invention.

FIG. 5 is the LED backlight driving circuit provided by the second embodiment of this invention, the circuit of FIG. 5 and the one of FIG. 2 is similar, therefore the same component symbols stand for the same components, the main difference between the first embodiment and this embodiment is that the boosted circuit 240 adds the third capacitor C3.

Referring to FIG. 5, in this embodiment, the anode of the first diode D1 is indirectly electrically connected to the output terminal of the inductor L, in specific the third capacitor C3 is added between the first diode D1 and the inductor L. Specifically, the output terminal of the inductor L through the third capacitor C3 is connected to the anode of the first diode Q1, namely one end of the third capacitor C3 is electrically connected to the output of the inductor L, i.e. the end of the third capacitor C3 is also electrically connected to the anode of the second diode D2 and the drain of the first transistor Q1, the other end of the third capacitor C3 is electrically connected to the anode of the first diode D1, i.e. the third capacitor C3 is electrically connected to the cathode of the third diode D3. Therefore, in the first period, the power source charges the third capacitor C3 via the inductor L, at this time the current flow is: Vin→the Inductor L→the third capacitor C3→the first diode D1→the first LED string 110→the second transistor Q2→resistor→ground, and Vin→inductor L→the third capacitor C3→the first diode D1→the first capacitor C1→ground; in the second period, the third capacitor C3 discharges, at this time the current flow is: the second capacitor C2→the second LED string 120→the third diodes D3→the third capacitor C3→the first transistor Q1→resistor→ground, and the fourth capacitor C4→the third diodes D3→the third capacitor C3→the first transistor Q1→resistor→ground.

Thus, according to FIG. 5, the average current value through the first LED string 110 in the first period and the second period is equal to the one through the first diode D1 in the first period and the second period, namely the average current value through the first LED string 110 in a cycle is equal to the one through the first diode D1 in a cycle, namely $I_{avLED1}=I_{avD1}$; the average current value through the second LED string 120 in the first period and the second period is equal to the one through the third diode D3 in the first period and the second period, namely the average current value through the second LED string 120 in a cycle is equal to the one through the third diode D3 in a cycle, namely $I_{LED2}=I_{avD3}$; and during the first period and the second period, or a cycle, charging and discharging of the third capacitor C3 are in an equilibrium, so that $I_{avD1}=I_{avD3}$; so that $I_{LED1}=I_{avD1}=I_{avD3}=I_{LED2}$, so that the average brightness of the first LED string 110 and the second LED string 120 in a cycle is the same, so that the brightness around the liquid crystal display is more balanced, the display quality of the liquid crystal display is improved, and the grade of the liquid crystal display is improved.

It should be noted that embodiments of the present description all are described in a progressive manner, each embodiment focuses on differences from other embodiments, and reference may be made between embodiments for identical or similar portions. Regarding an apparatus embodiment, since it is substantially similar to the method embodiment, it is described relatively simply and reference may be made to partial depictions of the method embodiment for relevant portions.

By the above described embodiments, this invention has the following advantages:

Due to the way from separating one circuit of the existing LED string into two circuits of the first and the second LED string, so that voltages of the first and second LED strings outputted via the boosted circuit can be reduced relative to the prior art, thereby conversion efficiency of the boosted circuit can be improved to save energy; and driving a large number of LED lights can be achieved.

Disclosed above is only one preferred embodiment of the present invention, which does not impose undue constraints to the scope of protection of the present invention, therefore the equivalent changes made according to the claims of this invention are still within the scope of the present invention.

What is claimed is:

1. A light-emitting diode (LED) backlight driving circuit, comprising:

a first LED string, located on a first branch circuit, and comprising a number of LED lights, the first LED string having a first terminal and an opposite terminal connected to ground;

a second LED string, located on a second branch circuit different from the first branch circuit, and comprising a number of LED lights, the second LED string having a first terminal and an opposite second terminal connected to ground;

a first capacitor, having a first terminal connected electrically with the first terminal of the first LED string and an opposite second terminal that is directly connected to ground;

a second capacitor, having a first terminal connected electrically to the first terminal of the second LED string, and an opposite second terminal that is directly connected to ground;

a boosted circuit, having an input terminal electrically connected to the power source for receiving power therefrom, and an output terminal electrically connected to the first terminal of the first capacitor, the first terminal of the second capacitor, the first terminal of the first LED string, and the first terminal of the second LED string; and an LED controller, connected electrically to the boosted circuit, wherein in a first period of an operation cycle, the LED controller controls the boosted circuit to supply power to the first branch circuit and to charge the first capacitor and also to supply power to the second branch circuit and to charge the second capacitor; and in a second period of the operation cycle, the LED controller controls the boosted circuit to cut off the supply of the power from the boosted circuit to the first branch circuit and the first capacitor so that the first capacitor discharges power that is fed through the first branch circuit, and the LED controller also controls the boosted circuit to cut off the supply of the power from the boosted circuit to the second branch circuit and the second capacitor so that the second capacitor discharges power that is fed through to the second branch circuit;

wherein the boosted circuit comprises:

an inductor, having an input terminal electrically connected to the power source and an output terminal;

a first diode, having an anode electrically connected to the output terminal of the inductor and a cathode electrically connected to the first terminal of the first LED string and the first terminal of the first capacitor;

a second diode, having an anode electrically connected to the output terminal of the inductor and a cathode electrically connected to the first terminal of the second LED string and the first terminal of the second capacitor;

a third diode, having an anode electrically connected to the second terminal of the second LED string and a cathode electrically connected to the anode of the first diode;

a first transistor, having a drain electrically connected to the output terminal of the inductor and a source is electrically grounded and a control terminal electrically connected to the LED controller.

2. The LED backlight driving circuit according to claim 1, wherein the boosted circuit further comprises a third capacitor, and the output terminal of the inductor is electrically connected to the first diode anode through the third capacitor.

3. The LED backlight driving circuit according to claim 1, wherein a fourth capacitor has a first terminal electrically connected to the second terminal of the second LED string and an opposite second terminal connected to ground.

4. The LED backlight driving circuit according to claim 3, wherein the second capacitor provides a voltage that is greater than a voltage provided by the fourth capacitor during the second period d.

5. The LED backlight driving circuit according to claim 1, wherein, in the first period, the first transistor is turned off; the first diode and the second diode are turned on; the third diode is turned off; and in the second period, the first transistor is turned on; the first diode and the second diode are turned off; and the third diode is turned on.

6. The LED backlight driving circuit according to claim 1, wherein the first transistor is an NMOS transistor.

7. The LED backlight driving circuit according to claim 1, wherein the number of LED lights of the first LED string comprise at least two LED lights connected in series and the number of LED lights of the second LED string comprise at least two LED lights connecting in series.

8. The LED backlight driving circuit according to claim 1, wherein the number of LED lights of the first LED string and the number of the LED lights of the second LED strings are equal.

9. A liquid crystal display, comprising a liquid crystal panel and a backlight module opposite to each other, the backlight module providing a light source to the liquid crystal panel to enable the liquid crystal panel to display an image, wherein the backlight module comprises a light-emitting diode (LED) backlight driving circuit that comprises:

a first LED string, located on a first branch circuit, and comprising a number of LED lights, the first LED string having a first terminal and an opposite terminal connected to ground;

a second LED string, located on a second branch circuit different from the first branch circuit, and comprising a number of LED lights, the second LED string having a first terminal and an opposite second terminal connected to ground;

a first capacitor, having a first terminal connected electrically with the first terminal of the first LED string and an opposite second terminal that is directly connected to ground;

a second capacitor, having a first terminal connected electrically to the first terminal of the second LED string, and an opposite second terminal that is directly connected to ground;

a boosted circuit, having an input terminal electrically connected to the power source for receiving power therefrom, and an output terminal electrically connected to the first terminal of the first capacitor, the first terminal of the second capacitor, the first terminal of the first LED string, and the first terminal of the second LED string; and an LED controller, connected electrically to the boosted circuit, wherein in a first period of an operation cycle, the LED controller controls the boosted circuit to supply power to the first branch circuit and to charge the first capacitor and also to supply power to the second branch circuit and to charge the second capacitor; and in a second period of the operation cycle, the LED controller controls the boosted circuit to cut off the supply of the power from the boosted circuit to the first branch circuit and the first capacitor so that the first capacitor discharges power that is fed through the first branch circuit, and the LED controller also controls the boosted circuit to cut off the supply of the power from the boosted circuit to the second branch circuit and the second capacitor so that the second capacitor discharges power that is fed through to the second branch circuit;

wherein the boosted circuit comprises:

an inductor, having an input terminal electrically connected to the power source and an output terminal;

a first diode, having an anode electrically connected to the output terminal of the inductor and a cathode electrically connected to the first terminal of the first LED string and the first terminal of the first capacitor;

a second diode, having an anode electrically connected to the output terminal of the inductor and a cathode electrically connected to the first terminal of the second LED string and the first terminal of the second capacitor a third diode, having an anode electrically connected to the second terminal of the second LED string and a cathode electrically connected to the anode of the first diode;

a first transistor, having a drain electrically connected to the output terminal of the inductor and a source electrically connected to ground and a control terminal electrically connected to the LED controller.

10. The liquid crystal display according to claim 9, wherein the boosted circuit further comprises a third capacitor, and the output terminal of the inductor is electrically connected to the first diode anode through the third capacitor.

11. The liquid crystal display according to claim 9, wherein the LED backlight driving circuit further comprises a fourth capacitor that has a first terminal electrically connected to the second terminal of the second LED string and an opposite second terminal connected to ground.

12. The liquid crystal display according to claim 11, wherein the second capacitor provides a voltage that is greater than a voltage provided by the fourth capacitor during the second period.

13. The liquid crystal display according to claim 9, wherein, in the first period, the first transistor is turned off; the first diode and the second diode are turned on; the third diode is turned off; and in the second period, the first transistor is turned on; the first diode and the second diode are turned off; and the third diode is turned on.

14. The liquid crystal display according to claim 9, wherein the first transistor is an NMOS transistor.

15. The liquid crystal display according to claim 9, wherein the number of LED lights of the first LED string comprise at least two LED lights connected in series and the number of LED lights of the second LED string comprise at least two LED lights connecting in series.

16. The liquid crystal display according to claim 9, wherein the number of LED lights of the first LED string and the number of the LED lights of the second LED strings are equal.

* * * * *